US011187466B2

(12) United States Patent
Schoneboom

(10) Patent No.: US 11,187,466 B2
(45) Date of Patent: Nov. 30, 2021

(54) HEAT EXCHANGER AND HEAT EXCHANGING SYSTEM

(71) Applicant: DENSO International America, Inc., Southfield, MI (US)

(72) Inventor: Sean Paul Wade Schoneboom, Livonia, MI (US)

(73) Assignee: DENSO International America, Inc., Southfield, MI (US)

( * ) Notice: Subject to any disclaimer, the term of this patent is extended or adjusted under 35 U.S.C. 154(b) by 314 days.

(21) Appl. No.: 16/522,892

(22) Filed: Jul. 26, 2019

(65) Prior Publication Data

US 2021/0025656 A1 Jan. 28, 2021

(51) Int. Cl.

| | |
|---|---|
| ***F28D 7/02*** | (2006.01) |
| ***F28F 1/12*** | (2006.01) |
| ***F28F 1/02*** | (2006.01) |
| ***F28D 1/047*** | (2006.01) |

(52) U.S. Cl.

CPC ..... *F28D 7/02* (2013.01); *F28F 1/02* (2013.01); *F28F 1/128* (2013.01); *F28D 1/0473* (2013.01); *F28F 2215/06* (2013.01)

(58) Field of Classification Search

CPC ..... F28F 1/02; F28F 2215/06; F28D 7/02; F28D 1/0473

See application file for complete search history.

(56) References Cited

U.S. PATENT DOCUMENTS

| | | | | | |
|---|---|---|---|---|---|
| 205,153 | A * | 6/1878 | Tregent | F28D 7/024 | 165/163 |
| 1,776,135 | A * | 9/1930 | Smith | F22G 3/002 | 122/476 |
| 4,523,637 | A * | 6/1985 | Abramo | F28D 7/06 | 165/104.34 |
| 5,832,739 | A * | 11/1998 | Bacchus | F28D 7/024 | 62/310 |
| 6,203,707 | B1 * | 3/2001 | Hartmann | B01D 63/02 | 210/650 |
| 6,488,079 | B2 * | 12/2002 | Zifferer | F28F 1/06 | 165/133 |
| 7,308,932 | B2 * | 12/2007 | Doh | B01D 63/02 | 165/158 |
| 7,487,799 | B2 * | 2/2009 | Wobben | F15D 1/065 | 138/37 |
| 9,909,783 | B2 * | 3/2018 | Jensen | F24T 10/15 | |
| 10,914,524 | B2 * | 2/2021 | Yanik | F28F 9/0282 | |

(Continued)

FOREIGN PATENT DOCUMENTS

| | | | | |
|---|---|---|---|---|
| CN | 201811261370 A | 2/2019 | | |
| DE | 202010014956 U1 * | 2/2011 | | F28F 1/022 |

(Continued)

*Primary Examiner* — Paul Alvare

(74) *Attorney, Agent, or Firm* — Brooks Kushman P.C.

(57) ABSTRACT

A heat exchanger includes a first header tank, a second header tank, and a plurality of tubes. The plurality of tubes is arranged in braided pairs that extend in and are configured to direct a fluid between the first and second header tanks in a first direction. Each of the plurality of tubes have opposing ends that are respectively secured to the first and second header tanks via elbows such that the plurality of tubes are offset from the first and second header tanks.

16 Claims, 4 Drawing Sheets

(56) References Cited

U.S. PATENT DOCUMENTS

| | | | | |
|---|---|---|---|---|
| 2002/0053422 | A1* | 5/2002 | Juslenius | F28F 1/122 165/133 |
| 2005/0266790 | A1* | 12/2005 | Yu-Lin | G06F 1/20 454/184 |
| 2018/0283795 | A1* | 10/2018 | Cerny | F28F 9/02 |

FOREIGN PATENT DOCUMENTS

| | | | | |
|---|---|---|---|---|
| GB | 191415510 | A * | 6/1915 | B21C 37/15 |
| WO | 2015149107 | A1 | 10/2015 | |
| WO | 2016093541 | | 6/2016 | |
| WO | WO-2018189860 | A1 * | 10/2018 | F28D 7/02 |

* cited by examiner

HEAT EXCHANGER AND HEAT EXCHANGING SYSTEM

TECHNICAL FIELD

The present disclosure relates to heat exchangers, particularly to tube and fin type heat exchangers.

BACKGROUND

Tube and fin heat exchangers may be utilized to transfer heat between a fluid flowing through the tubes of the heat exchanger and air that is being direct across the fins of the heat exchanger.

SUMMARY

A heat exchanger includes a first header tank, a second header tank, and a plurality of tubes. The plurality of tubes is arranged in braided pairs that extend in and are configured to direct a fluid between the first and second header tanks in a first direction. Each of the plurality of tubes have opposing ends that are respectively secured to the first and second header tanks via elbows such that the plurality of tubes are offset from the first and second header tanks.

A heat exchanging system includes a first header tank, a second header tank, a plurality of tubes, and a plurality of cooling fins. The plurality of tubes extends in and is configured to direct a fluid between the first and second header tanks in a first direction. Each of the plurality of tubes have opposing ends that are respectively secured to the first and second header tanks at an angle such that central portions of each of the plurality of tubes are offset from the first and second header tanks. The plurality of cooling fins extends between adjacent central portions of the plurality of tubes. The fins are arranged to define a plurality of openings that extend in the first direction.

A heat exchanging system includes a first header tank, a second header tank, a plurality of tubes, and an air scoop. The plurality of tubes is configured to direct a fluid between the first and second header tanks in a first direction. Each tube has opposing ends that are respectively secured to the first and second header tanks via elbows such that each tube is offset from the first and second header tanks. The air scoop is disposed about the plurality of tubes and is configured to direct air between adjacent tubes in a second direction that is substantially parallel and opposite to the first direction.

DETAILED DESCRIPTION

Embodiments of the present disclosure are described herein. It is to be understood, however, that the disclosed embodiments are merely examples and other embodiments may take various and alternative forms. The figures are not necessarily to scale; some features could be exaggerated or minimized to show details of particular components. Therefore, specific structural and functional details disclosed herein are not to be interpreted as limiting, but merely as a representative basis for teaching one skilled in the art to variously employ the embodiments. As those of ordinary skill in the art will understand, various features illustrated and described with reference to any one of the figures may be combined with features illustrated in one or more other figures to produce embodiments that are not explicitly illustrated or described. The combinations of features illustrated provide representative embodiments for typical applications. Various combinations and modifications of the features consistent with the teachings of this disclosure, however, could be desired for particular applications or implementations.

Figure 1:
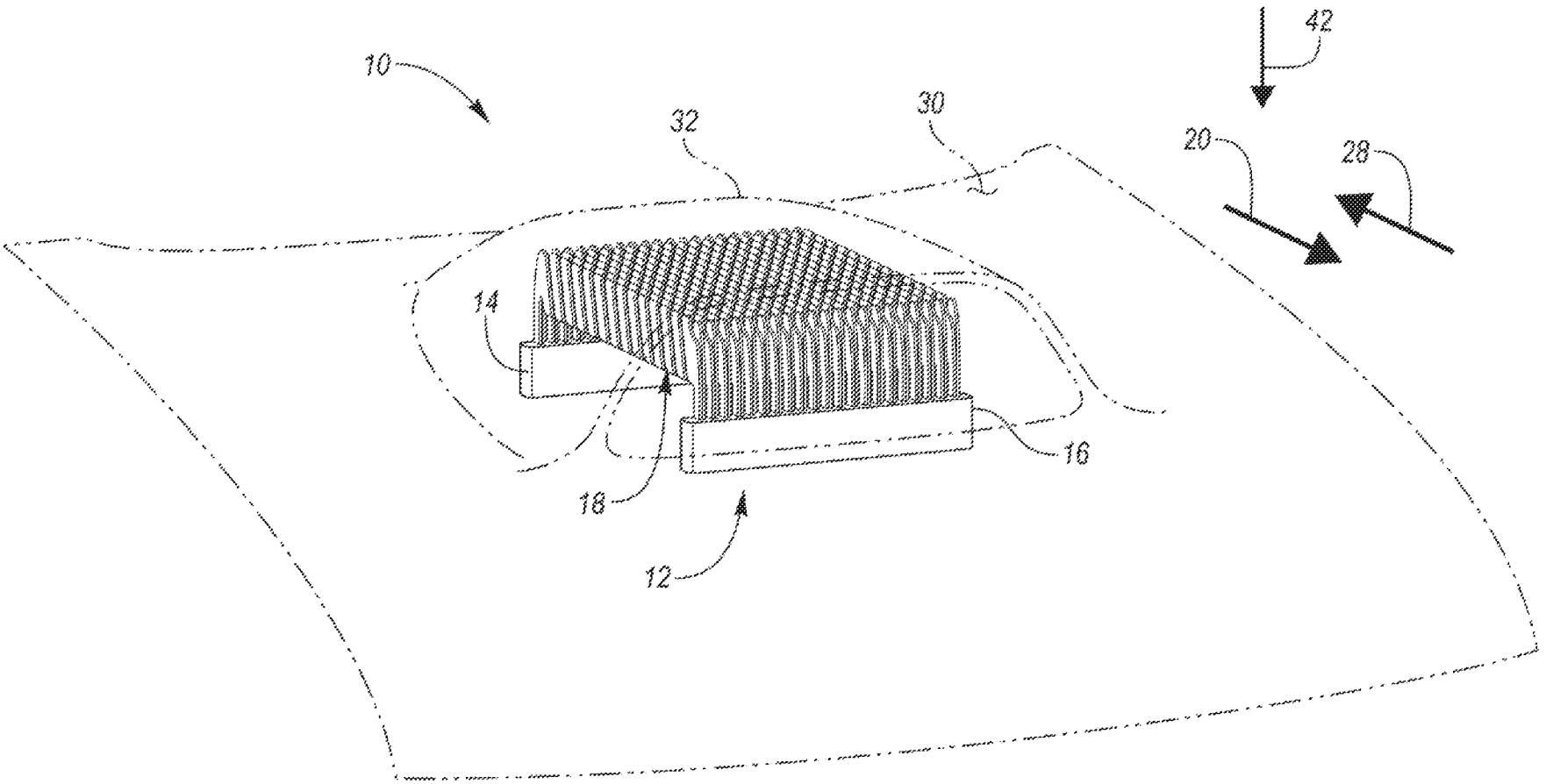
FIG. 1 is an isometric view of a heat exchanging system that includes a heat exchanger that protrudes outward from a vehicle panel.
Figure 2:
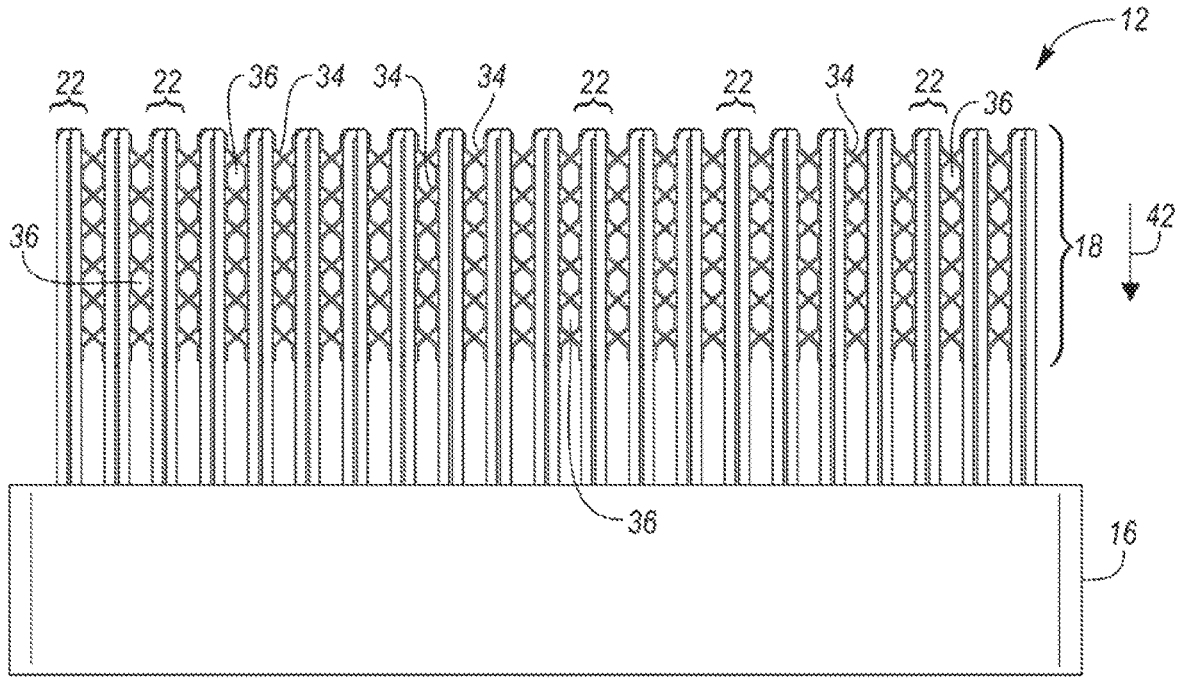
FIG. 2 is a front view of the heat exchanger.
Figure 3:
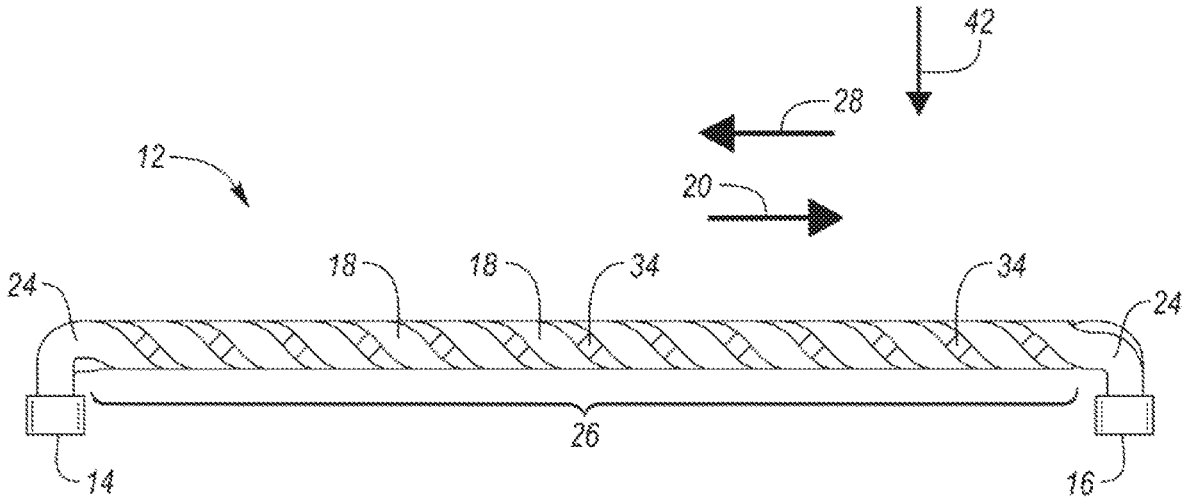
FIG. 3 is a side view of the heat exchanger.

Referring to FIGS. 1-3, a heat exchanging system 10, and more particularly, a heat exchanger 12, are illustrated. The heat exchanger 12 includes a first header tank 14 and a second header tank 16. The heat exchanger 12 includes a plurality of tubes 18 that extend in a first direction 20 between the first header tank 14 and the second header tank 16. The plurality of tubes 18 may also be configured to direct a heat exchanging fluid between the first header tank 14 and the second header tank 16 in the first direction 20. More specifically, the heat exchanging system 10 may be a system that is configured to cool a vehicle component, such as in internal combustion engine, and may include a device such as a pump that is configured to direct the heat exchanging fluid through the vehicle component that is being cooled and through the plurality of tubes 18 between the first header tank 14 and the second header tank 16 in the first direction 20.

The plurality of tubes 18 may be arranged in braided pairs 22 of tubes 18 that extend between the first header tank 14 and the second header takes 16. Each of the tubes 18 may be a flat tube that is formed into a ribbon spring type shape and is intertwined with another tube 18 to form one of the braided pairs. Such a configuration also the fluid within the tubes 18 resulting in a more even exchange of heat. More specifically, the fluid will travel through each of the tubes 18 in a flattened helical pattern between the first header tank 14 and the second header tank 16 in the first direction 20.

Each tube of the plurality of tubes 18 have opposing ends that are respectively secured to the first header tank 14 and second header tank 16, respectively, at an angle via elbows 24 such that the plurality of tubes 18 are offset from the first header tank 14 and the second header tank 16. More specifically, each tube of the plurality of tubes 18 have opposing ends that are respectively secured to the first header tank 14 and second header tank 16, respectively, at an angle via elbows 24 such that central portions 26 of the plurality of tubes 18 are offset from the first header tank 14 and the second header tank 16. An elbow 24 may be integral to an end of each tube 18 or may alternatively be separate components that connect the ends of each to 18 to the first header tank 14 and second header tank 16. The opposing ends of each of the plurality of tubes 18 may be respectively secured to the first header tank 14 and the second header tank 16 at a substantially perpendicular angle via the elbows 24 (i.e., each of the elbows 24 may be bent downward at a substantially perpendicular angle relative to the plurality of tubes 18). Substantially perpendicular may refer to any incremental angle that ranges between exactly perpendicular and 20 from exactly perpendicular (i.e., substantially perpendicular may refer to an angle that ranges between 70° and 110°).

Positioning the plurality of tubes 18, or more specifically the central portions 26 of the plurality of tubes 18, such that they are offset from the first header tank 14 and the second header takes 16, allows for an external heat exchanging medium or fluid (i.e., a gas or a liquid) to flow through the heat exchanger 12 in a second direction 28 that is substantially parallel to the plurality of tubes 18, or more specifically to the central portions 26 of the plurality of tubes 18, and opposite to the first direction 20. Substantially parallel may refer to any incremental angle that ranges between exactly parallel and 20° from exactly parallel. This creates a counter flow of the external medium relative to the heat exchanging fluid flowing through the plurality of tubes 18. A heat exchanger that is arranged in such a counter flowing configuration exchanges heat efficiently. The external medium may comprise a gas such as air that is directed across the plurality of tubes 18 in the second direction 28 or may comprise a fluid, such as refrigerant or coolant, flowing through a second set of tubes that are in contact with the tubes of the plurality of tubes 18. Such a fluid may be directed through a second set of tubes via compressor or pump that is configured to direct the fluid through the second set of tubes in the second direction 28.

In an air-cooled configuration, the plurality of tubes 18, or more specifically the central portions 26 of the plurality of tubes 18, may protrude outward from an external surface of a vehicle panel 30, such as a roof panel, door panel, floor panel, hood, truck lid, etc. In such a configuration, the air may be configured to flow through the heat exchanger 12 in the second direction 28 by simply driving the vehicle or by directing the air through the heat exchanger via a fan. Also, in the alternative, the plurality of tubes 18, or more specifically the central portions 26 of the plurality of tubes 18, may be shaped to follow a contour of the external surface of the vehicle body panel 30. The vehicle may include a cowl or air scoop 32 that is disposed about the plurality of tubes 18 and is configured to direct air between adjacent tubes in the second direction 28, which is substantially parallel and opposite to the first direction, when the vehicle is driven.

The heat exchanger 12 may also include a plurality of cooling fins 34 that extend between adjacent tubes of the plurality of tubes 18 or between adjacent braided pairs 22 of tubes of the plurality of tubes 18. More specifically, the cooling fins 34 may extend between the central portions 26 of adjacent tubes 18 or the central portions 26 of adjacent pairs 22 of tubes. The cooling fins 34 are arranged to define openings 36 that extend in the first direction 20. The openings 36 are configured to channel air between the adjacent tubes 18 or the adjacent braided pairs 22 of tubes 18. More specifically, the openings 36 may be configured to channel air between the adjacent tubes 18 or the adjacent braided pairs 22 of tubes 18 in the second direction 28 that is parallel and opposite to the first direction 20. The cooling fins 34 may be configured to enhance and increase heat transfer between the heat exchanging fluid flowing through the plurality of tubes 18 and the air that is being directed across the heat exchanger 12. Therefore, the cooling fins 34 may be made from a material that efficiently conducts and transfers heat between two mediums such as aluminum or steel.

Figure 4:
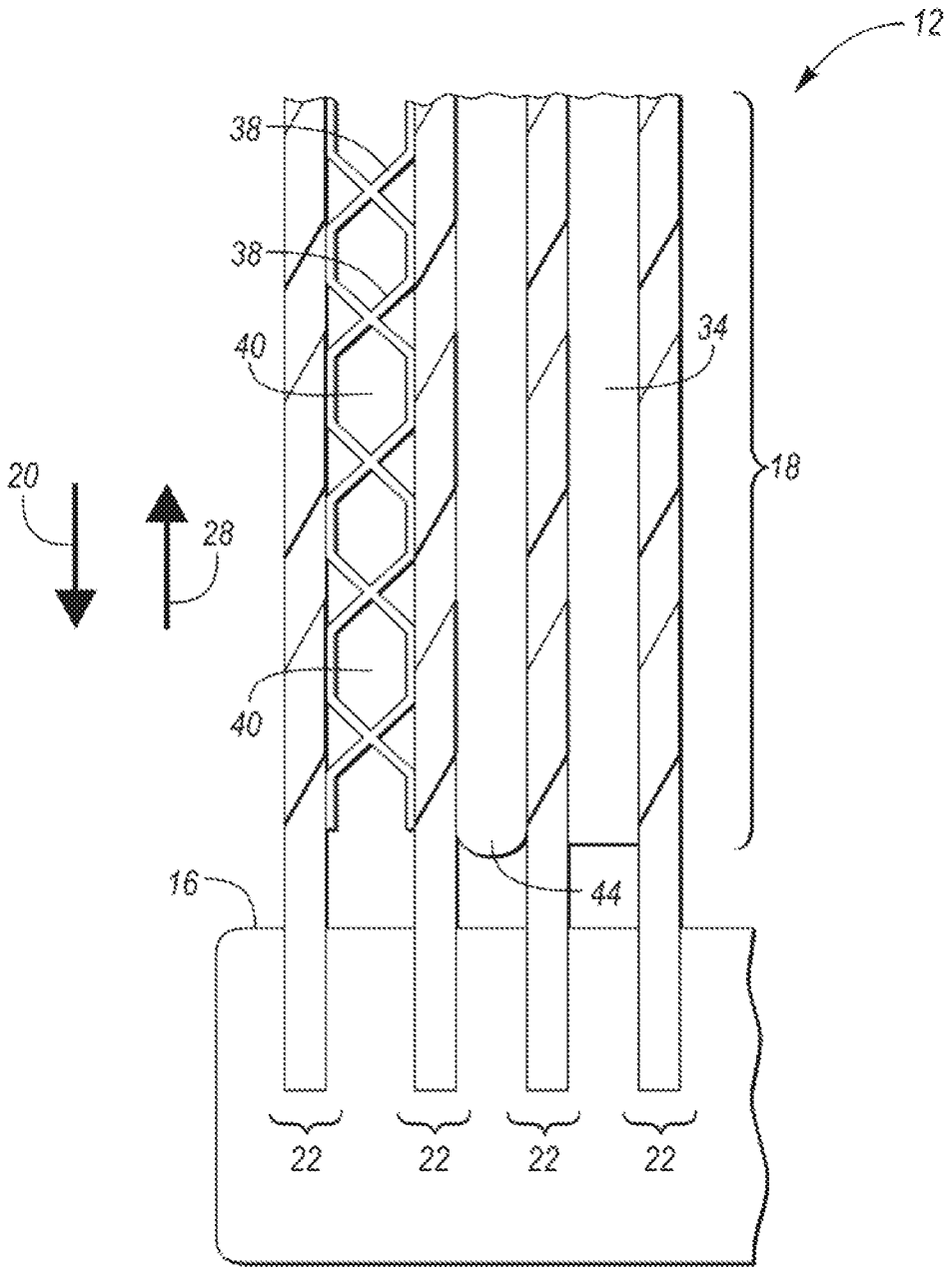
FIG. 4 is a partial front view of the heat exchanger illustrating several structures that may be utilized to enhance heat transfer between a fluid flowing within the tubes of the heat exchanger and an external medium.
Figure 5:
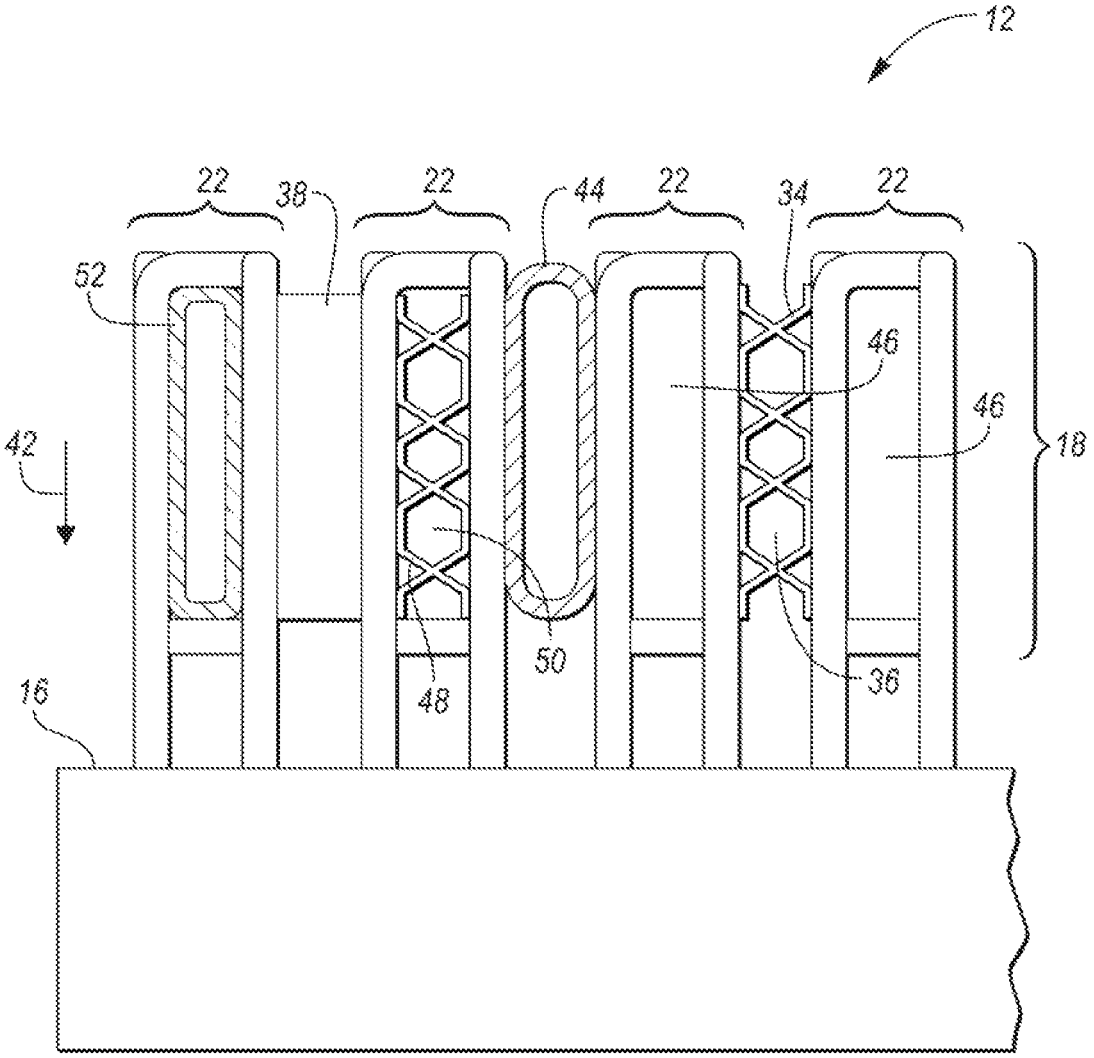
FIG. 5 is a partial top view of the heat exchanger illustrating several structures that may be utilized to enhance heat transfer between a fluid flowing within the tubes of the heat exchanger and an external medium.

Referring now to FIGS. 4 and 5, a partial front view and a partial top view of the heat exchanger 12 are illustrated, respectively. FIGS. 4 and 5, however, illustrate several structures that may be utilized to enhance and increase the heat transfer between the heat exchanging fluid flowing within the plurality of tubes 18 of the heat exchanger 12 and an external medium, in addition to the plurality of cooling fins 34 or in the alternative to the plurality of cooling fins 34.

The heat exchanger 12 may include a second plurality of cooling fins 38 that extend between adjacent tubes of the plurality of tubes 18 or between adjacent braided pairs 22 of tubes of the plurality of tubes 18. Again, the second plurality of cooling fins 38 may be utilized to enhance and increase the heat transfer between the heat exchanging fluid flowing within the plurality of tubes 18 of the heat exchanger 12 and an external medium (e.g., air), in addition to or in the alternative of the plurality of cooling fins 34, or any other structure disclosed herein that may be utilized to enhance heat transfer between the fluid flowing within the plurality of tubes 18 and an external medium. For example, the fins of the second plurality of cooling fins 38 may be disposed within some or all of the spaces defined between each tube 18 or the spaces defined between each braded pair 22 of tubes 18. More specifically, the cooling fins 38 may extend between the central portions 26 of adjacent tubes 18 or the central portions 26 of adjacent pairs 22 of tubes. The cooling fins 38 are arranged to define openings 40 that extend in a third direction 42 that is substantially perpendicular to the first direction 20 and the second direction 28. The openings 40 are configured to channel air between the adjacent tubes 18 or the adjacent braided pairs 22 of tubes 18. More specifically, the openings 40 may be configured to channel air between the adjacent tubes 18 or the adjacent braided pairs 22 of tubes 18 in the third direction 42 that is substantially perpendicular to the first direction 20 and the second direction 28. The cooling fins 38 may be configured to enhance and increase heat transfer between the heat exchanging fluid flowing through the plurality of tubes 18 and the air that is being directed across the heat exchanger 12. Therefore, the cooling fins 38 may be made from a material that efficiently conducts and transfers heat between two mediums such as aluminum or steel.

The heat exchanger 12 may include a second plurality of tubes 44 that are each configured to direct a second heat exchanging fluid in the second direction 28 that is opposite to the first direction 20. The second heat exchanging fluid may be directed through the second plurality of tubes 44 in the second direction 28 via a pump or compressor. It should be noted that tube 44 in FIG. 4 is shown as a cross-section for illustrative purposes. Each tube of the second plurality of tubes 44 may be disposed between adjacent tubes of the plurality of tubes 18 or between adjacent braided pairs 22 of tubes of the plurality of tubes 18. Each of the tubes of the second plurality of tubes 44 may be in contact with one or more adjacent tubes 18 or adjacent braided pairs 22 of tubes 18 to facilitate heat transfer from the heat exchanging fluid flowing within the plurality of tubes 18 to the second heat exchanging fluid flowing within the second plurality of tubes 44. Again, the second plurality of tubes 44 may be utilized to enhance and increase the heat transfer between the heat exchanging fluid flowing within the plurality of tubes 18 of the heat exchanger 12 and an external medium (e.g., the second heat exchanging fluid flowing through the second plurality of tubes 44), in addition to or in the alternative of the plurality of cooling fins 34, or any other structure disclosed herein that may be utilized to enhance heat transfer between the fluid flowing within the plurality of tubes 18 and an external medium. For example, the tubes of the second plurality of tubes 44 may be disposed within some or all of the the spaces defined between each tube 18 or the spaces defined between each braded pair 22 of tubes 18.

Each of the braided pairs 22 of tubes of the plurality of tubes 18 may define a central orifice or opening 46. Cooling ins from a third plurality of cooling fins 48 may be disposed within one or more of the central openings 46. Again, the third plurality of cooling fins 48 may be utilized to enhance and increase the heat transfer between the heat exchanging fluid flowing within the plurality of tubes 18 of the heat exchanger 12 and an external medium (e.g., air), in addition to or in the alternative of the plurality of cooling fins 34, or any other structure disclosed herein that may be utilized to enhance heat transfer between the fluid flowing within the plurality of tubes 18 and an external medium. The cooling fins 48 may be disposed within one or more of the central openings 46 between the central portions 26 of pairs 22 of tubes. The cooling fins 48 are arranged to define openings 50 that extend in the first direction 20. The openings 50 are configured to channel air through the central openings 46 defined by the braided pairs 22 of tubes 18. More specifically, the openings 50 may be configured to channel air through the central openings 46 in the second direction 28 that is parallel and opposite to the first direction 20. The cooling fins 48 may be configured to enhance and increase heat transfer between the heat exchanging fluid flowing through the plurality of tubes 18 and the air that is being directed across the heat exchanger 12. Therefore, the cooling fins 48 may be made from a material that efficiently conducts and transfers heat between two mediums such as aluminum or steel.

The heat exchanger 12 may include a third plurality of tubes 52 that are each configured to direct a third heat exchanging fluid in the second direction 28 that is opposite to the first direction 20. The third heat exchanging fluid may be directed through the third plurality of tubes 52 in the second direction 28 via a pump or compressor. It should be noted that tube 52 in FIG. 4 is shown as a cross-section for illustrative purposes. Each tube of the third plurality of tubes 52 may be disposed within one of the central openings 46 defined by each of the braided pairs 22 of tubes of the plurality of tubes 18. Each of the third plurality of tubes 52 may be in contact with one or more adjacent tubes 18 in order to facilitate heat transfer from the heat exchanging fluid flowing within the plurality of tubes 18 to the third heat exchanging fluid flowing within the third plurality of tubes 52. More specifically, each of the third plurality of tubes 52 may be in contact with a surrounding braided pair 22 of tubes 18 that defines the central opening 46 that the specific tube 52 is disposed within. Again, the third plurality of tubes 52 may be utilized to enhance and increase the heat transfer between the heat exchanging fluid flowing within the plurality of tubes 18 of the heat exchanger 12 and an external medium (e.g., the third heat exchanging fluid flowing through the third plurality of tubes 52), in addition to or in the alternative of the plurality of cooling fins 34, or any other structure disclosed herein that may be utilized to enhance heat transfer between the fluid flowing within the plurality of tubes 18 and an external medium.

It should be understood that the designations of first, second, third, fourth, etc. for header tanks, plurality of fins, openings, direction, or any other component, state, or condition described herein may be rearranged in the claims so that they are in chronological order with respect to the claims.

The words used in the specification are words of description rather than limitation, and it is understood that various changes may be made without departing from the spirit and scope of the disclosure. As previously described, the features of various embodiments may be combined to form further embodiments that may not be explicitly described or illustrated. While various embodiments could have been described as providing advantages or being preferred over other embodiments or prior art implementations with respect to one or more desired characteristics, those of ordinary skill in the art recognize that one or more features or characteristics may be compromised to achieve desired overall system attributes, which depend on the specific application and implementation. As such, embodiments described as less desirable than other embodiments or prior art implementations with respect to one or more characteristics are not outside the scope of the disclosure and may be desirable for particular applications.

What is claimed is:

1. A heat exchanger comprising:

first and second header tanks;

a plurality of tubes arranged in braided pairs that extend in and are configured to direct a fluid between the first and second header tanks in a first direction, each of the plurality of tubes having opposing ends that are respectively secured to the first and second header tanks via elbows such that the plurality of tubes are offset from the first and second header tanks; and a second plurality of tubes that are each configured to direct a second fluid in a second direction that is opposite to the first direction, wherein each tube of the second plurality of tubes is disposed between and in contact with adjacent braided pairs.

2. The heat exchanger of claim 1 further comprising cooling fins that extend between adjacent braided pairs, wherein the fins are arranged to define openings that extend in the first direction and are configured to channel air between the adjacent braided pairs.

3. The heat exchanger of claim 1 further comprising cooling fins that extend between adjacent braided pairs, wherein the fins are arranged to define openings that extend in a third direction that is substantially perpendicular to the first direction and are configured to channel air between the adjacent braided pairs in the third direction.

4. The heat exchanger of claim 1, wherein each of the braided pairs define a central opening, and wherein cooling fins are disposed within the central openings.

5. The heat exchanger of claim 1, wherein each of the braided pairs define a central opening and further comprising a third plurality of tubes that are each configured to direct a third fluid in a third direction that is opposite to the first direction, wherein each tube of the third plurality of tubes is disposed within one of the central openings and in contact one of the braided pairs.

6. The heat exchanger of claim 1, wherein each of the elbows is bent downward at a substantially perpendicular angle relative to the plurality of tubes.

7. A heat exchanging system comprising:

first and second header tanks;

a plurality of tubes that extend in and is configured to direct a fluid between the first and second header tanks in a first direction, each of the plurality of tubes having opposing ends that are respectively secured to the first and second header tanks at an angle such that central portions of each of the plurality of tubes are offset from the first and second header tanks, wherein the plurality of tubes is arranged in braided pairs;

a second plurality of tubes that are each configured to direct a second fluid in a second direction that is opposite to the first direction, wherein each tube of the second plurality of tubes is disposed between and in contact with adjacent braided pairs; and a plurality of cooling fins extending between adjacent central portions of the plurality of tubes, the fins arranged to define a plurality of openings that extend in the first direction.

8. The heat exchanging system of claim 7, wherein each of the braided pairs define a central opening.

9. The heat exchanging system of claim 8, wherein a second plurality of cooling fins is disposed within the central openings.

10. The heat exchanging system of claim 9, wherein the second plurality of cooling fins define a second plurality of openings that extend in the first direction.

11. The heat exchanging system of claim 7, wherein the opposing ends of each tube are respectively secured to the first and second header tanks at a substantially perpendicular angle.

12. The heat exchanging system of claim 7 further comprising an air scoop disposed adjacent to the plurality of tubes and configured to direct air into the openings.

13. A heat changing system comprising:

first and second header tanks;

a plurality of tubes configured to direct a fluid between the first and second header tanks in a first direction, each tube having opposing ends that are respectively secured to the first and second header tanks via elbows such that each tube is offset from the first and second header tanks, wherein the plurality of tubes is arranged in braided pairs;

a second plurality of tubes that are each configured to direct a second fluid in a second direction that is opposite to the first direction, wherein each tube of the second plurality of tubes is disposed between and in contact with adjacent braided pairs; and an air scoop disposed adjacent to the plurality of tubes and configured to direct air between adjacent tubes in the second direction that is substantially parallel and opposite to the first direction.

14. The heat exchanging system of claim 13 further comprising a plurality of cooling fins extending between adjacent tubes of the plurality of tubes, the cooling fins arranged to define a plurality of openings that are configured to direct air between adjacent tubes in the second direction.

15. The heat exchanging system of claim 13, wherein each of the braided pairs define a central opening, and wherein a plurality of cooling fins is disposed within the central openings.

16. The heat exchanging system of claim 13, wherein each of the braided pairs define a central opening, and further comprising a third plurality of tubes that are each configured to direct a third fluid in the second direction that is opposite to the first direction, wherein each tube of the third plurality of tubes is disposed within one of the central the central openings and in contact one of the braided pairs.

* * * * *